US010053918B2

(12) United States Patent
SadAbadi et al.

(10) Patent No.: US 10,053,918 B2
(45) Date of Patent: Aug. 21, 2018

(54) CATCH MECHANISM FOR RETAINING COMPONENTS IN A DOWNHOLE MOTOR

(71) Applicant: Halliburton Energy Services, Inc., Houston, TX (US)

(72) Inventors: Hamid SadAbadi, Edmonton (CA); Hossam Gharib, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/126,885

(22) PCT Filed: Nov. 19, 2015

(86) PCT No.: PCT/US2015/061531

§ 371 (c)(1),
(2) Date: Sep. 16, 2016

(87) PCT Pub. No.: WO2017/086967

PCT Pub. Date: May 26, 2017

(65) Prior Publication Data

US 2017/0260813 A1 Sep. 14, 2017

(51) Int. Cl.

| | |
|---|---|
| ***E21B 4/02*** | (2006.01) |
| ***E21B 12/00*** | (2006.01) |
| ***E21B 41/00*** | (2006.01) |
| *E21B 4/00* | (2006.01) |

(52) U.S. Cl.
CPC ..... *E21B 12/00* (2013.01); *E21B 4/02* (2013.01); *E21B 41/0021* (2013.01); *E21B 4/003* (2013.01)

(58) Field of Classification Search
CPC ..... E21B 41/0021; E21B 4/02
See application file for complete search history.

(56) References Cited

U.S. PATENT DOCUMENTS

| | | | |
|---|---|---|---|
| 2005/0126828 | A1 | 6/2005 | Pinol et al. |
| 2014/0060936 | A1 | 3/2014 | Connell et al. |
| 2014/0079574 | A1 | 3/2014 | Brunner et al. |
| 2014/0332275 | A1 | 11/2014 | Murray et al. |
| 2015/0068810 | A1 | 3/2015 | Altimas |

OTHER PUBLICATIONS

"International Application Serial No. PCT/US2015/061531, International Search Report dated Aug. 19, 2016", 3 pgs.
"International Application Serial No. PCT/US2015/061531, Written Opinion dated Aug. 19, 2016", 6 pgs.

*Primary Examiner* — Giovanna Collins Wright
(74) *Attorney, Agent, or Firm* — Chamberlain Hrdlicka

(57) ABSTRACT

Methods and apparatus are disclosed for retaining components in a downhole motor in the event of a mechanical separation or failure of one or more components therein. As described, the retention mechanism does not require a threaded connection to components of the mud motor drivetrain. Downhole motor assemblies including the new catch mechanism also include a structural element to engage the catch assembly and the components to which it is attached in the event of a mechanical failure within the mud motor assembly.

25 Claims, 11 Drawing Sheets

FIG. 5A
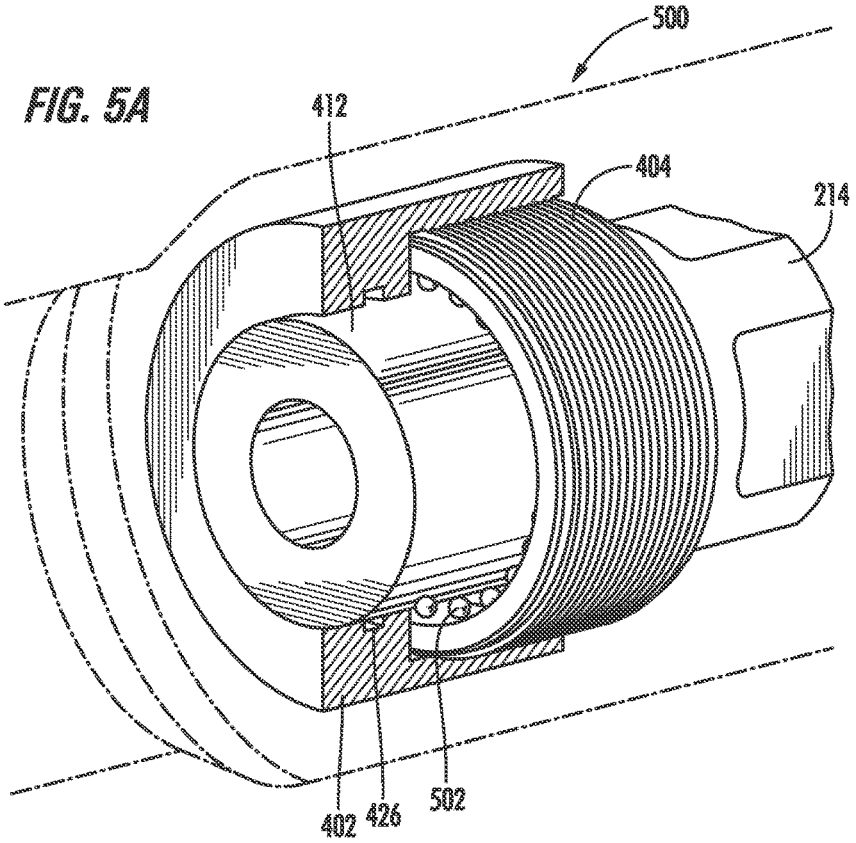
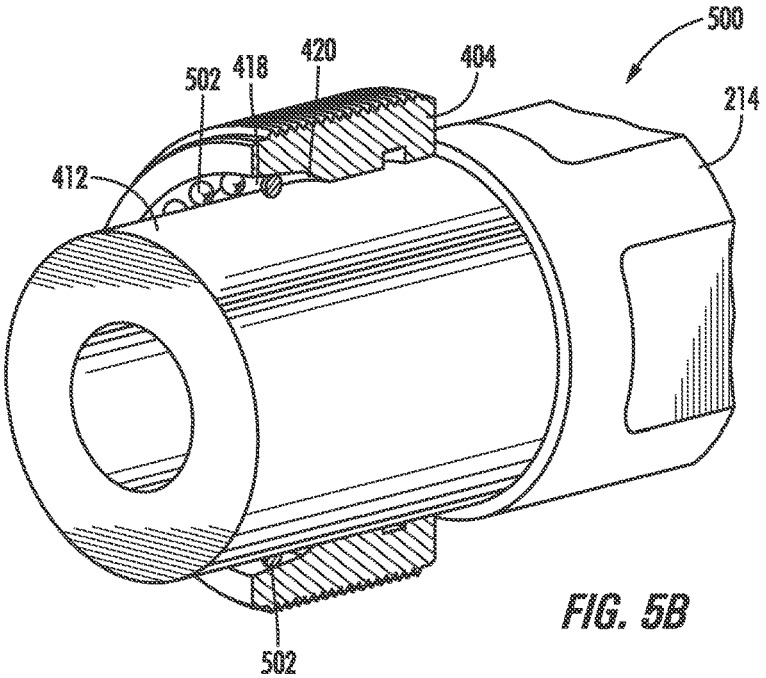
FIG. 5B

FIG. 6A
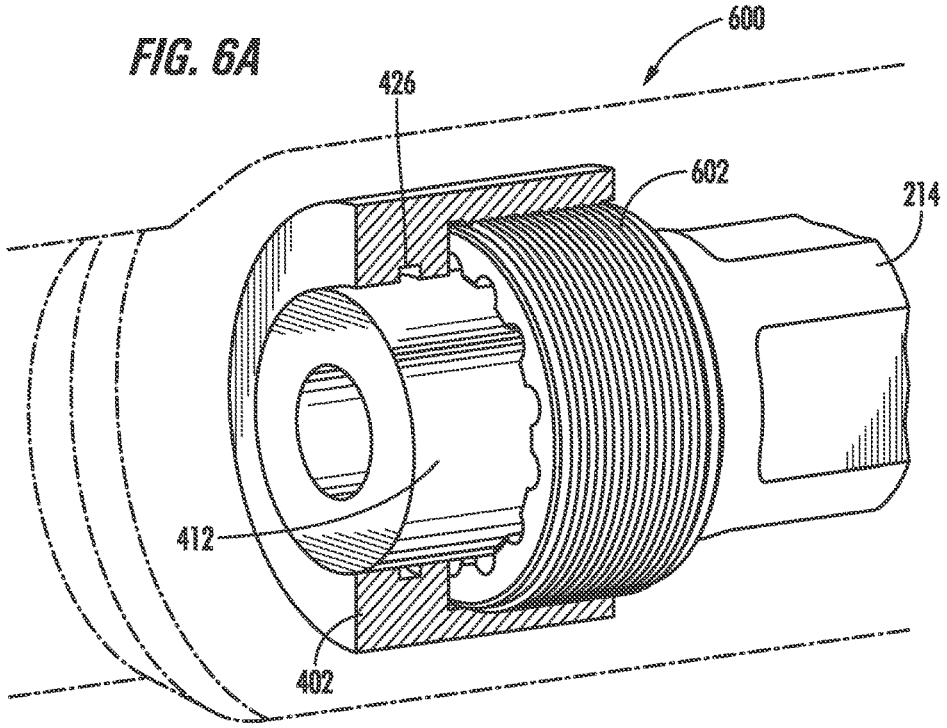
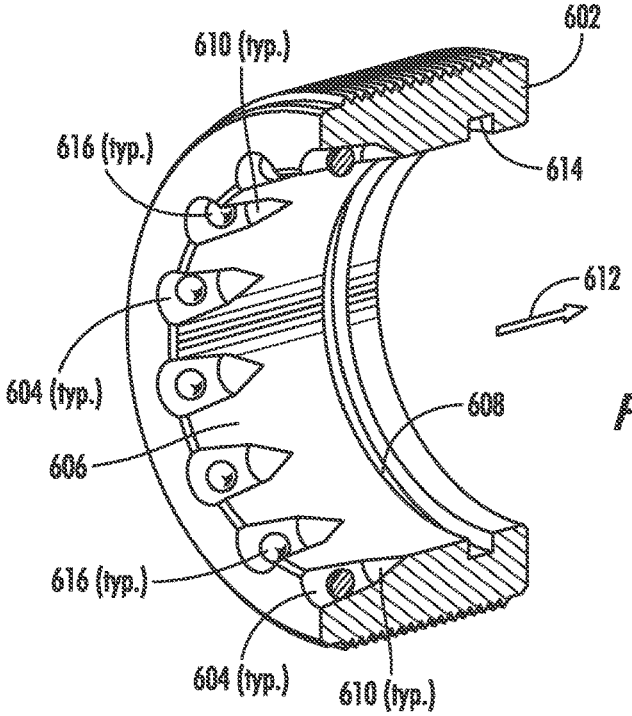
FIG. 6B

CATCH MECHANISM FOR RETAINING COMPONENTS IN A DOWNHOLE MOTOR

PRIORITY APPLICATIONS

This application is a U.S. National Stage Filing under 35 U.S.C. § 371 from International Application No. PCT/US2015/061531, filed on Nov. 19, 2015, which application is incorporated herein by reference in its entirety.

BACKGROUND

The present disclosure relates generally to methods and apparatus for retaining components in a downhole motor in the event of a mechanical separation or failure of one or more components therein; and more specifically relates to a catch mechanism which may be secured to a desired component in the downhole motor (such as, for example, the rotor of the motor, or a component of a driveshaft assembly, as will typically be coupled to a downhole end of the rotor). As discussed in more detail later herein, the described catch mechanism engages the downhole motor component without requiring a threaded engagement to the component, which is particularly advantageous. The catch mechanism described herein is configured to actuate to dynamically engage a surface of the motor component to secure the catch mechanism in a fixed longitudinal position relative to the component when excessive motion of the motor component occurs.

The use of downhole motors in drilling operations is well known. The most common such downhole motors are positive displacement-type motors, which include a power section having a lobed stator and a differently lobed rotor therein, where pumping of drilling mud through the power section causes rotation of the rotor. The power section is coupled to a transmission assembly, in which a drivetrain assembly is coupled to the rotor and extends through a bearing pack that facilitates changing the eccentric rotation of the rotor to single axis rotation proximate the lower end of the drivetrain assembly.

One concern that can exist with downhole motors is the risk that in the event of a mechanical separation or failure during use in a well, some portion of the rotor, or of the drivetrain assembly coupled thereto, may separate from the remainder of the motor assembly and be lost in the well. In that situation, the drill string will have to be removed from the well, and fishing and/or milling operations performed to remove the separated components from the wellbore. Such remedial efforts are obviously time-consuming and expensive.

In many circumstances, such as where wells are drilled offshore, sometimes to great depths, the drilling can be difficult, with exceptional loads and stress placed upon all components in the drill string, particularly on the driven components of the downhole motor and the other components coupled thereto. As a result, catch mechanisms have been proposed for use with downhole motor components, which threadably couple to the motor component to create an expanded dimension of the catch mechanism sufficient to engage an integral portion of the motor assembly, such as a shoulder extending inwardly from the housing, or another component supported by the housing. Such mechanisms, while generally satisfactory for the catch function, present other difficulties.

After use of a downhole motor, the motor will be torn down and inspected, and in most cases refurbished for another use. Threaded components in the motor drivetrain necessitate a more rigorous examination during such inspections, such as a black light inspection (often by a third party), before refurbishment can occur. Additionally, a threaded component of a downhole motor drivetrain provides a potential disadvantage because of the stresses that can occur in a threaded coupling, as it can represent another potential point of failure. Thus, it would be highly beneficial to have a catch mechanism that engages the downhole motor drivetrain components sufficiently securely to retain the components in the event of a mechanical failure, but without the need for a threaded engagement with a drivetrain component.

BRIEF DESCRIPTION OF THE DRAWINGS

FIGS. 5A-B are each depictions of a second example embodiment of a catch assembly; shown in an oblique view and vertical section in FIG. 5A; and in an oblique and cutaway view in FIG. 5B.

FIGS. 6A-B are each depictions of a third example embodiment of a catch assembly; shown in an oblique view and vertical section in FIG. 6A; and in an oblique and cutaway view in FIG. 6B.

DETAILED DESCRIPTION

Figure 1:
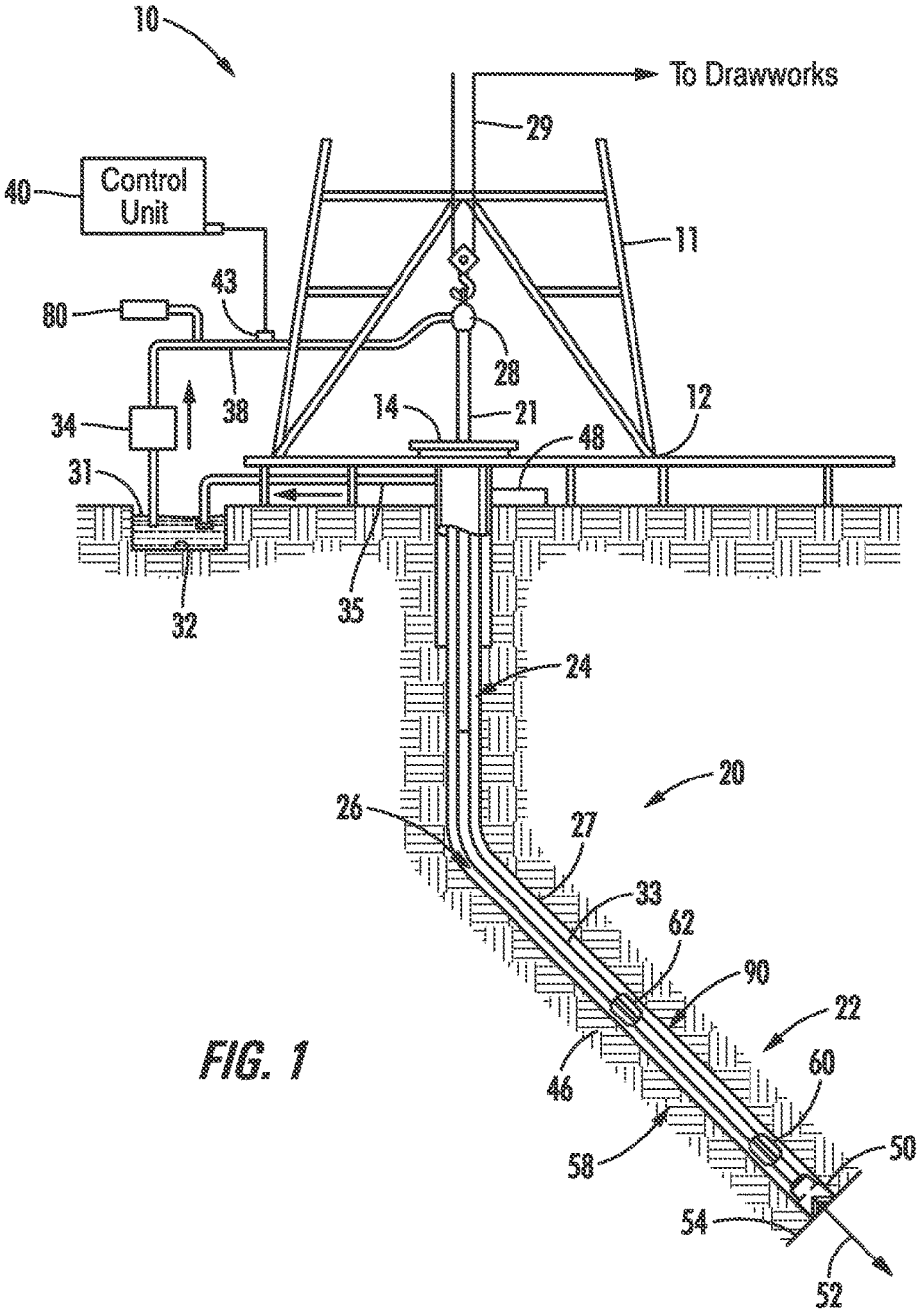
FIG. 1 is a schematic diagram of a drill string including a downhole mud motor disposed in a well in one example operating environment.

The present disclosure describes new methods and apparatus for retaining components in a downhole motor in the event of a mechanical separation or failure of one or more components therein; and does so without requiring a threaded connection to the mud motor drivetrain components. The embodiments described herein include a mud motor having a catch assembly that will selectively engage a component of the motor drivetrain to secure the catch assembly in a desired position to an internal motor component, without requiring threads on the drivetrain component. In these described embodiments, the catch assembly includes a body assembly housing one or more engagement members that are movably received within a tapered recess of the body assembly proximate. The dimensions of the recess allow the one or more engagement members to contact the drivetrain component to be engaged.

In response to downward movement of the drivetrain component, and thereby also of the engagement member(s), relative to the body member, the taper of the recess causes the engagement member(s) to tightly engage the drivetrain components. The greater the downward force applied, the greater the force of the engagement of the engagement member(s) with the drivetrain components. In some embodiments, the body assembly will define a recess that tapers in decreasing depth in both and downhole directions relative to a central region. In these embodiments, the catch assembly engages the drivetrain components in response to relative movement relative to the drivetrain components in both uphole and downhole directions.

The following detailed description describes example embodiments of the new mud motor configuration including the new catch assembly with reference to the accompanying drawings, which depict various details of examples that show how the disclosure may be practiced. The discussion addresses various examples of novel methods, systems and apparatus in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

Referring now FIG. 1, that figure schematically depicts an example directional drilling system, indicated generally at 10, which includes a positive displacement-type mud motor assembly 90 as may benefit from use of the structures and methods described herein. Many of the disclosed concepts are discussed with reference to drilling operations for the exploration and/or recovery of subsurface hydrocarbon deposits, such as petroleum and natural gas. However, the disclosed concepts are not so limited, and can be applied to other drilling operations. To that end, the aspects of the present disclosure are not necessarily limited to the arrangement and components presented in FIG. 1. For example, many of the features and aspects presented herein can be applied in horizontal drilling applications and vertical drilling applications without departing from the intended scope of the present disclosure. In addition, it should be understood that the drawings are not to scale and are provided purely for descriptive purposes; thus, the individual and relative dimensions and orientations presented in the drawings are not to be considered limiting.

Directional drilling system 10 includes a derrick 11, supporting a derrick floor 12. Derrick floor 12 supports a rotary table 14 that is driven at a desired rotational speed, for example, via a chain drive system through operation of a prime mover (not depicted). Rotary table 14, in turn, provides the necessary rotational force to a drill string 20. Drill string 20, includes a drill pipe section 24, which extends downwardly from the rotary table 14 into a directional borehole 26. As illustrated in the Figures, borehole 26 may travel along a multi-dimensional path or "trajectory." The three-dimensional direction of the bottom 54 of the borehole 26 of FIG. 1 is represented by a pointing vector 52.

A drill bit 50 is attached to the distal, downhole end of the drill string 20. When rotated, e.g., via the rotary table 14, the drill bit 50 operates to break up penetrate the geological formation 46. Drill string 20 is coupled through a kelly joint 21, swivel 28, and line 29 to a drawworks (not depicted). The drawworks may include various components, including a drum, one or more motors, a reduction gear, a main brake, and an auxiliary brake; and during a drilling operation can be operated to control the weight on bit 50 and the rate of penetration of drill string 20 into borehole 26. The structure and operation of such drawworks are generally known and are thus not described in detail herein.

During drilling operations, a suitable drilling fluid (commonly referred to in the art as drilling "mud") 31 can be circulated, under pressure, out of a mud pit 32 and into the borehole 26 through the drill string 20 by a hydraulic "mud pump" 34. The drilling fluid 31 may comprise, for example, water-based muds (WBM), which typically comprise one or more of a water-and-clay based composition; an oil-based mud (OBM), where the base fluid is a petroleum product, such as diesel fuel; or a synthetic-based mud (SBM), where the base fluid is a synthetic oil. Drilling fluid 31 passes from the mud pump 34 into drill string 20 via a fluid conduit (commonly referred to as a "mud line") 38 and the kelly joint 21. Drilling fluid 31 is discharged at the borehole bottom 54 through an opening or nozzle in the drill bit 50, and circulates in an "uphole" direction towards the surface through annulus 27, between the drill string 20 and the side of the borehole 26. As the drilling fluid 31 approaches the rotary table 14, it is discharged via a return line 35 into a mud pit 32. A variety of surface sensors 48, which are appropriately deployed on the surface of the borehole 26, operate alone or in conjunction with downhole sensors deployed within the borehole 26, to provide information about various drilling-related parameters, such as fluid flow rate, weight on bit, hook load, etc.

A surface control unit 40 may receive signals from surface and downhole sensors and devices via a sensor or transducer 43, which can be placed on the fluid line 38 to detect the mud pulses responsive to the data transmitted by the downhole transmitter 33. The transducer 43 in turn generates electrical signals, for example, in response to the mud pressure variations and transmits such signals to the surface control unit 40. Alternatively, other telemetry techniques such as electromagnetic and/or acoustic techniques or any other suitable techniques may be utilized. By way of example, wired drill pipe may be used to communicate between the surface and downhole devices. The surface control unit 40 can be operable to process such signals according to programmed instructions provided to surface control unit 40. Surface control unit 40 may present to an operator desired drilling parameters and other information via one or more output devices, such as a display, a computer monitor, speakers, lights, etc., which may be used by the operator to control the drilling operations. Surface control unit 40 may contain a computer, memory for storing data, a data recorder, and other known and hereinafter developed peripherals. Surface control unit 40 may also include models and may process data according to programmed instructions, and respond to user commands entered through a suitable input device, which may be in the nature of a keyboard, touch-screen, microphone, mouse, joystick, etc.

In some embodiments of the present disclosure, the rotatable drill bit 50 is attached at a distal end of a steerable drilling bottom hole assembly (BHA) 22. In the illustrated embodiment, the BHA 22 is coupled between the drill bit 50 and the drill pipe section 24 of the drill string 20. The BHA 22 may comprise a Measurement While Drilling (MWD) System, designated generally at 58, with various sensors to provide information about the formation 46 and downhole drilling parameters. The MWD sensors in the BHA 22 may include, but are not limited to, a device for measuring the formation resistivity near the drill bit, a gamma ray device for measuring the formation gamma ray intensity, devices for determining the inclination and azimuth of the drill string, and pressure sensors for measuring drilling fluid pressure downhole. The MWD may also include additional/alternative sensing devices for measuring shock, vibration, torque, telemetry, etc. The above-noted devices may transmit data to a downhole transmitter 33, which in turn transmits the data uphole to the surface control unit 40. In some embodiments, the BHA 22 may also include a Logging While Drilling (LWD) System.

The BHA 22 can provide some or all of the requisite force for drill bit 50 to break through the formation 46 (known as "weight on bit"), and provide the necessary directional control for drilling the borehole 26. In the embodiments illustrated in FIGS. 1 and 2, the BHA 22 includes a drilling motor 90 and first and second longitudinally spaced stabilizers 60 and 62. At least one of the stabilizers 60, 62 may be an adjustable stabilizer that is operable to assist in controlling the direction of the borehole 26. The drilling motor 90 will typically be in the form of a positive displacement-type mud motor driven by circulation of the drilling mud (and will subsequently be referred to here as a "mud motor").

Circulation of the drilling mud causes rotation of a rotor within the power section of the mud motor 90 relative to a stator of the motor. The operation of such a mud motor is well known to persons skilled in the art, and will not be further addressed here. In conventional such positive displacement-type mud motors, the rotor follows an orbital, or eccentric, rotational path relative to the stator, which is typically generally aligned with the axis of the drill string in the region proximate the mud motor power section. The mud motor power section is coupled to a motor transmission which provides the transition to other complements within the drill string. The motor transmission assembly includes a drivetrain which couples the eccentrically rotating rotor to a drive member rotating relative to a single axis, to facilitate rotation of a drill bit.

Figure 2:
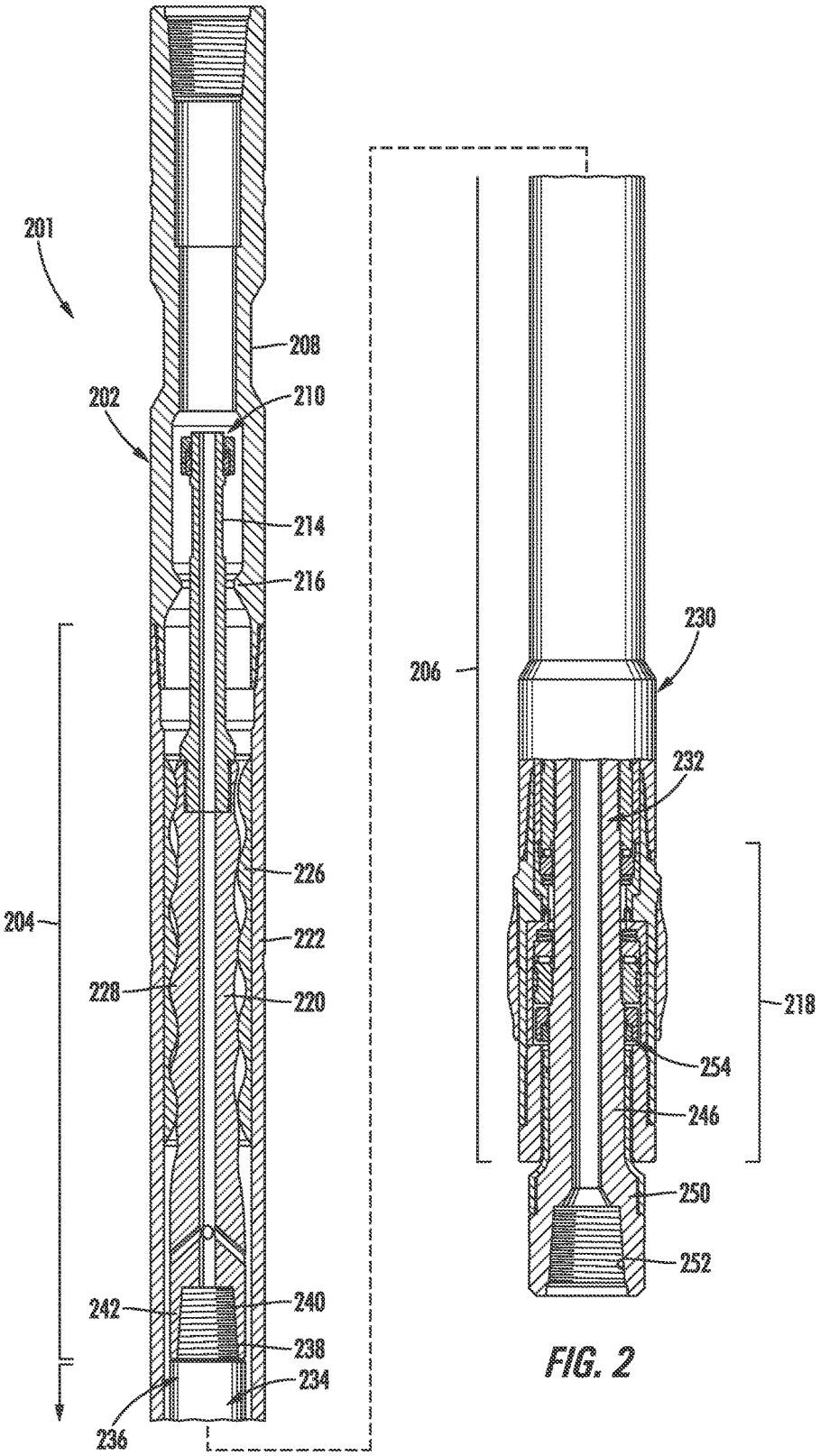
FIG. 2 is a partial vertical section of an example mud motor depicting two alternative configurations and placements for catch assemblies in accordance with the present disclosure.
Figure 3:
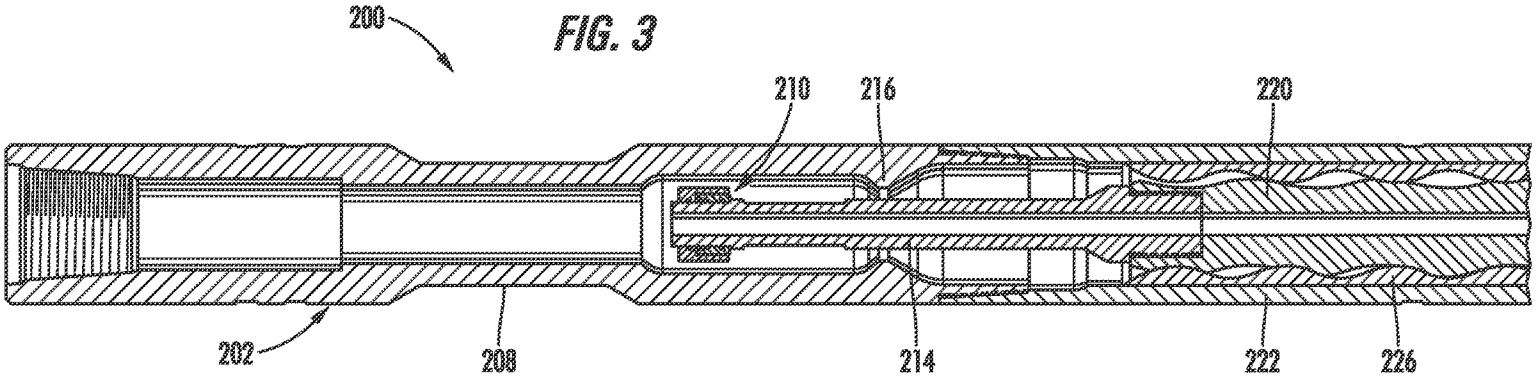
FIG. 3 is a vertical section depiction of the upper portion of the mud motor of FIG. 2, showing a first example embodiment of a catch assembly in greater detail, and in a first example placement.

Referring now to FIG. 2, the figure is a partial vertical section view of an example mud motor assembly 200. Mud motor assembly 200 includes an upper connection section, indicated generally at 202; which is coupled to a mud motor power section, indicated generally at 204; which is then coupled to a transmission and bearing assembly, indicated generally at 206. Upper connection section 202 includes a housing 208 which facilitates coupling of mud motor assembly 200 into the drill string (indicated at 20 in FIG. 1). Referring also to FIG. 3, that figure is an enlarged view of the portion of upper connection section 202 which houses a first catch assembly, indicated generally at 210. First catch assembly 210 engages an upper extension 214 which is coupled to rotor 220 of power section 204, and extends above rotor 220. Upper connection section 202 further defines an inwardly projecting shoulder 216 having an inner dimension configured to preclude passage of catch assembly 210, to thereby provide a "catch" function to retain components coupled to upper extension 214 in the event of a failure of one or more components that retain one or more components of the drivetrain within the remainder mud motor assembly 200. In the depicted example, inwardly projecting shoulder 216 is formed on an inner surface of housing 208.

Mud motor power section 204 includes a housing assembly 222 which forms a portion of the stator 224 of power section 204. In this example, mud motor power section 204 is a positive displacement-type motor, as discussed earlier herein, having a stator 224 that includes a plurality of inwardly projecting lobes (indicated generally at 226), while rotor 220 extends within stator 224 and has a differing set of external lobes (indicated generally at 228). In such positive displacement-type motors, mud traversing the irregularly-shaped annulus between rotor 220 and stator 224 will cause rotation of rotor 220. While a positive displacement-type mud motor is believed to be one configuration which will benefit from use of the present invention, other motors and/or other types of motors or other drive mechanisms may also benefit from incorporation of the methods and devices described herein.

Transmission and bearing assembly 206 includes an outer housing assembly 230, which couples to housing assembly 222 of power section 204, and includes at its lowermost extent, bearing assembly 218. The coupling between outer housing assembly 230 and housing assembly 222 may be either direct, or through one or more intermediate components. Transmission and bearing assembly 206 also includes a rotating drivetrain indicated generally at 232, which extends within housing assembly 222. In some embodiments rotating drivetrain 232 will include a driveshaft assembly 234, which connects to rotor 220, and also to an output shaft 246 portion which extends from the lower extent of driveshaft assembly 234. For purposes of the present description, the term "output shaft 246" will be used to refer to the portion of the drivetrain which extends through bearing assembly 218. Thus, the term is used only to refer to the relatively lower portion of the motor drivetrain, and does not suggest any structural distinction from any other portion of the drivetrain, beyond a locational portion of the drivetrain—that portion extending within bearing assembly 218.

Driveshaft assembly 234 includes a first end portion, indicated generally at 236, which forms one portion of a threaded coupling 238 which couples driveshaft assembly 234 to the rotor 220 of mud motor power section 204. In the depicted example, first end portion 236 includes a pin connection 240 configured to threadably couple to a box connection 242 of mud motor rotor 220. In some example constructions, box connection 242 will be a separate coupling fitting, secured either directly to rotor 220 or to one or more intervening component(s), which in turn engage rotor 220. In some examples, the placement of the pin connection 240 and box connection 242 in threaded coupling 238 may be reversed, such that the rotor (or rotor assembly) 220 terminates with the pin connection, and the central shaft portion 212 terminates with the box connection.

In some embodiments, it may be possible for the entire drivetrain (including driveshaft assembly 234 and output shaft 246) to be formed as a single structure. However, for many applications, it will be preferable for the portion termed herein the "output shaft 246" to be a separate component which couples to a lower portion of driveshaft assembly 234. Additionally, in many embodiments, driveshaft assembly 234 may itself include multiple components. For example, driveshaft assembly 234 serves to translate eccentric motion of the rotor 220 to single axis rotation proximate the bearing assembly 244 (and particularly the radial bearing assemblies as indicated at 706A, 706B in FIG. 7). Thus, in some embodiments, driveshaft assembly 234 may have a central portion configured for relative flexibility, in order to facilitate such function, but may have other sections configured to couple to other components of the drivetrain (for example, such as a separate output shaft 246 extending through bearing assembly 218, as identified earlier herein). The forming of driveshaft assembly of multiple components may ease manufacturing and transportation of the driveshaft assembly components. At the lower end output shaft 246 of the drivetrain 232 is a second end portion 250 which forms a portion of a second threaded coupling 252. Threaded coupling 252 facilitates coupling directly or indirectly to a drill bit or other rotating components (not depicted).

Bearing assembly 218 houses a second catch assembly, indicated generally at 254, (and depicted in more detail in FIGS. 7-11). In the depicted example, second catch assembly 254 engages an exterior surface of output shaft 246 as it extends through bearing assembly 218. In this example, the construction of second catch assembly 254 is different from that as will be described for first catch assembly 210. It should be understood that the reference to "first catch assembly" and "second catch assembly" is for clarity of reference in identifying two alternative configurations and placements for a catch assembly in FIG. 2, and does not suggest that all (or any) embodiments will necessarily include two catch assemblies. Many contemplated embodiments of mud motor assemblies will include only a single catch assembly located in a desired position; but other embodiments in accordance with the present disclosure may include two, or even more, catch assemblies.

Figure 4A:
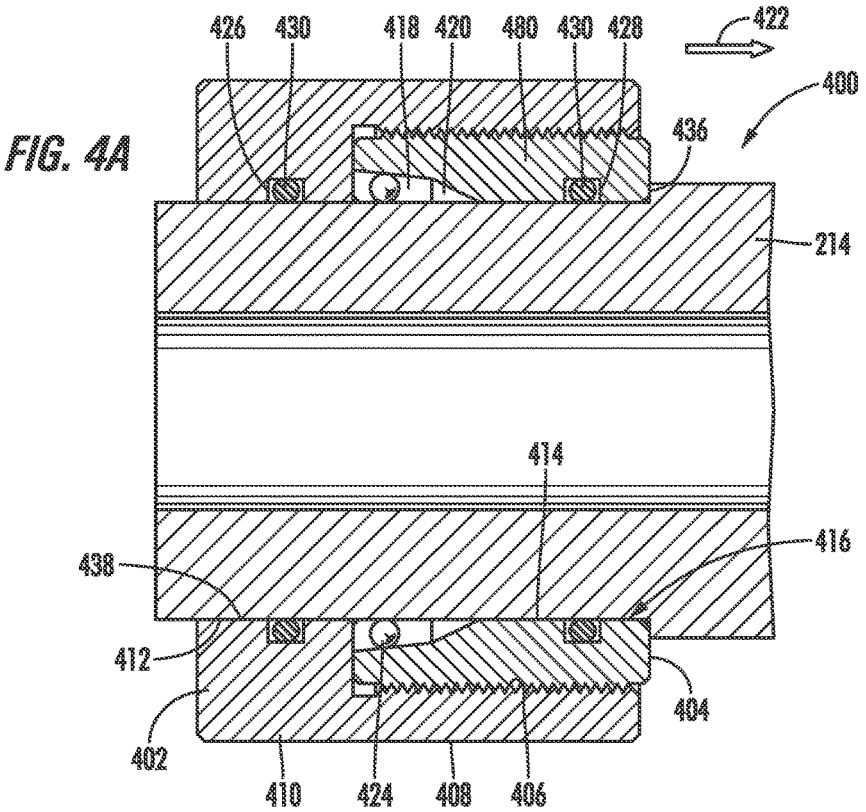
FIG. 4A-C are each depictions of a first example embodiment of a catch assembly; shown in vertical section in FIG. 4A; in an oblique vertical section in FIG. 4B; and in an oblique and cutaway view in FIG. 4C.
Figure 4B:
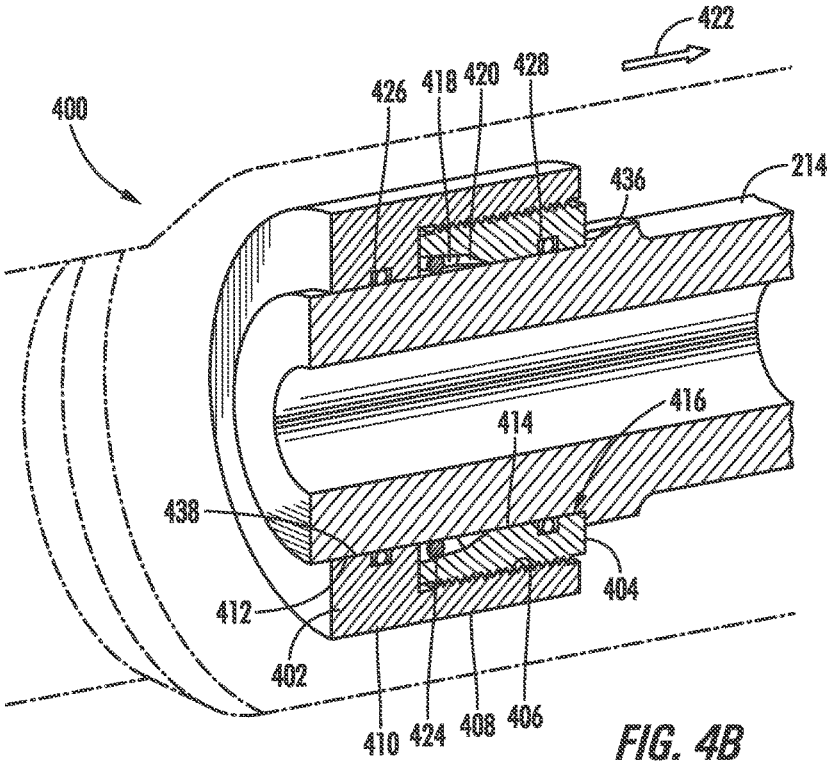
Figure 4C:
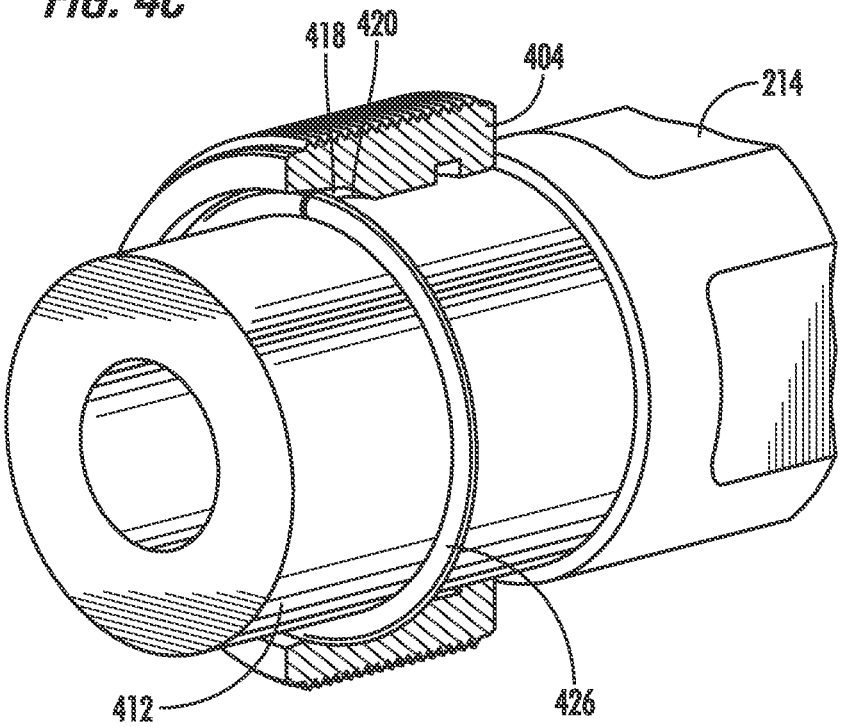

Referring now to FIGS. 4A-C, FIG. 4A is a vertical section of a first embodiment of a catch assembly; while FIG. 4B is a vertical section of the catch assembly of FIG. 4A from an oblique perspective; and FIG. 4C depicts the inner sleeve component and the locking member of the catch assembly in greater detail, with the outer sleeve component removed. The catch assembly 400 of FIGS. 4A-C is shown in an example configuration installed on upper section 214 as depicted in FIGS. 2 and 3. Catch assembly 400 includes an outer sleeve 402 and an inner sleeve 404 which joined together through a threaded coupling 406, formed in a flanged portion 408 of outer sleeve 402. Catch assembly 400 defines a central passage, indicated generally at 414, which extends concentrically to and closely engages a generally cylindrical surface 412 of upper section 214. In this example embodiment, upper section 214 defines a shoulder 436 adjacent cylindrical surface 412 to provide a seating area for catch assembly 400, to prevent downward movement thereof relative to upper section 214. Central passage 414 is defined in part by a cylindrical aperture 438 in base portion 410 of outer sleeve 402 and a central aperture 416 of the inner sleeve 404, each of such apertures 438, 416 being sized to closely engage the generally cylindrical surface 412 of upper section 214. In some embodiments, as depicted in the referenced figures, suitable sealing mechanisms, for example o-ring grooves 426, 428, with suitable o-rings 430, 432, may be provided in outer sleeve 402 and inner sleeve 404, respectively, to prevent fluid influx which could impair the functionality of catch assembly 400, as described below.

Inner sleeve 404 includes at least one locking member recess 418 formed adjacent central aperture 416, and extends circumferentially around the surface defining central aperture 416. Locking member recess 418 extends radially outwardly relative to the surface defining central aperture 416; and includes a tapered portion 420 which decreases in depth toward a relatively downhole direction of catch assembly 400, as indicated by arrow 422.

At least one locking member 424 is retained within locking member recess 418. Locking member 424 can be of any desired configuration suitable to engage generally cylindrical surface 412 of upper section 214 and to also cooperatively engage the surfaces defining tapered section 420 of locking member recess 418. In the embodiment of FIG. 4, locking member 424 is a generally annular member, preferably in the form of a "split ring" (i.e., forming essentially a complete circle but for a relatively small discontinuity 434 therein defining a gap. The gap is sized to facilitate compression of locking member 424 in response to movement within tapered section 420. One example configuration for locking member 424 suitable to cooperatively engage cylindrical surface 412 and the surfaces defining tapered section 420 is a generally circular cross-section, as depicted in the referenced figures. In other embodiments, locking member 424 might be configured with a different cross-section, such as, for example, a relatively oval cross-section, or a relatively egg-shaped cross-section. Where locking member 424 is a generally annular member it will preferably have a dimension, at least when installed within locking member recess 418, to provide a friction engagement with cylindrical surface 412, such that movement of upper section 214 relative to catch assembly 400 will cause movement of locking member 424 within locking member recess 418.

In operation, catch assembly 400 is configured to dynamically actuate in the event of a failure of support of mud motor rotor (220 in FIG. 2) or the drivetrain assembly 232 (also in FIG. 2) coupled thereto in its operating positioning within mud motor assembly 200, such as allows downward movement of mud motor rotor 220 and attached upper section 214. As previously described, the exterior dimensions of catch assembly 400 are sized such that catch assembly 400 will not pass through the aperture defined by an inwardly projecting restriction, such as radially inwardly-projecting shoulder 216 of FIG. 2, extending from housing assembly 208. Thus, downward movement of catch assembly 400 is limited, and due to the frictional engagement between locking member 424 and cylindrical surface 412, downward movement of upper section 214 relative to catch assembly 400 will cause locking member 424 to be pulled increasingly into tapered section 420 which will compress locking member 424 into ever tighter engagement with cylindrical surface 412. This engagement then further secures catch assembly 400 to upper section 214 and thereby prevents the section, and the components coupled thereto from falling away from the housing assemblies within mud motor assembly 200.

As an alternative to the generally annular locking member 424 of FIGS. 4A-B, multiple locking members might be used within one or more locking member recesses. For example, multiple rotating members might be included within circumferential locking member recess 418.

Referring now to FIGS. 5A-B, those figures depict an alternative embodiment of a catch assembly 500 which includes such multiple rotating locking members; depicted in FIG. 5A in partial vertical section and from an oblique view; and depicted in FIG. 5B without the outer sleeve component, to better show the remaining structure. For purposes of illustration of this embodiment, the structure of the components forming catch assembly 500 can be considered as identical to those of catch assembly 400 of FIGS. 4A-B, with the exception of the inclusion of multiple locking members 502, and the configuration of those locking members to be rotating members (as opposed to the sliding generally annular locking member 424 of those earlier figures). Thus, components which may be considered as the same as those of catch assembly 400 are numbered identically as in FIGS. 4A-B. Throughout this specification, where component is essentially identical to a component that was previously introduced, the identifying numeral of the originally-introduced component will be used.

While many configurations of such rotatable members can be envisioned, the use of spherical members, such as steel balls, is an example of a suitable configuration. Accordingly, each locking member 502 is a steel ball, and the locking members are present in sufficient number to provide a desired proximity to one another within locking member recess 418. Because the number the steel balls have an impact upon the surface area which engages cylindrical surface 412 of upper section 214, in many embodiments the steel balls will be present in a sufficient number as to substantially fill the circumferential dimension of locking member recess 418.

The locking functionality provided by catch assembly 500 is directly analogous to that previously described with respect to catch assembly 400 of FIGS. 4A-B. In catch assembly 500, just as annular locking member 424 of FIGS. 4A-B will be drawn into tighter engagement by tapered section 420 of locking member recess 418, locking members 502, in the form of steel balls disposed within locking member recess 418, will be drawn into tighter engagement through interaction with tapered section 420 of the recess. In some embodiments, the dimension of locking member recess 418 apart from tapered section 420 might be limited in its longitudinal dimension so as to avoid any of the steel balls from displacing from an essentially circumferential orientation (i.e., to maintain the steel balls essentially aligned, as in a ball bearing), in the absence of forces drawing them into tapered section 420.

Referring now to FIGS. 6A-B, those figures depict another alternative embodiment of a catch assembly 600, in which FIG. 6A is a partial vertical section of catch assembly 600; and FIG. 6B is a vertical section of only the inner sleeve and engagement member components of catch assembly 600, from an oblique perspective. For purposes of illustration of this embodiment, the structure of the outer sleeve component of catch assembly 600 can be considered as identical to that of outer sleeve 402. Catch assembly 600 differs substantially from catch assembly 400 in the configurations of inner sleeve 602 and of the engagement members 616. Again, components and elements that are essentially identical in construction to catch assembly 400 have been numbered identically here.

Catch assembly 600 represents an alternative to the placement of a plurality of rotatable locking members in a continuous circumferential locking member recess, as described relative to FIGS. 5A-B. In catch assembly 600, inner sleeve 602 includes a plurality of locking member recesses 604 in the inner surface 606 defining a central aperture 608 through the sleeve. The plurality of locking member recesses 604 are preferably circumferentially spaced, and in many embodiments will be evenly spaced around the circumference of inner surface 606. Each locking member recess 604 includes a respective tapered section 610 decreasing in dimension toward the longitudinally downhole direction, indicated by arrow 612. Again, inner sleeve 602 will, in some embodiments, include a groove 614 or other structure for supporting a fluid seal to prevent well fluids from entering locking member recesses 604.

Each locking member recess 604 will house at least one rotatable member, for example a steel ball 616, as described relative to FIGS. 5A-B. Catch assembly 600 presents the advantage that each steel ball locking member 616 is free to serve its engagement function with upper section 214 independently, without risk of any interference from other balls. Otherwise, the functioning of catch assembly 600 is directly analogous to that of catch assembly 500, discussed above.

Figure 7:
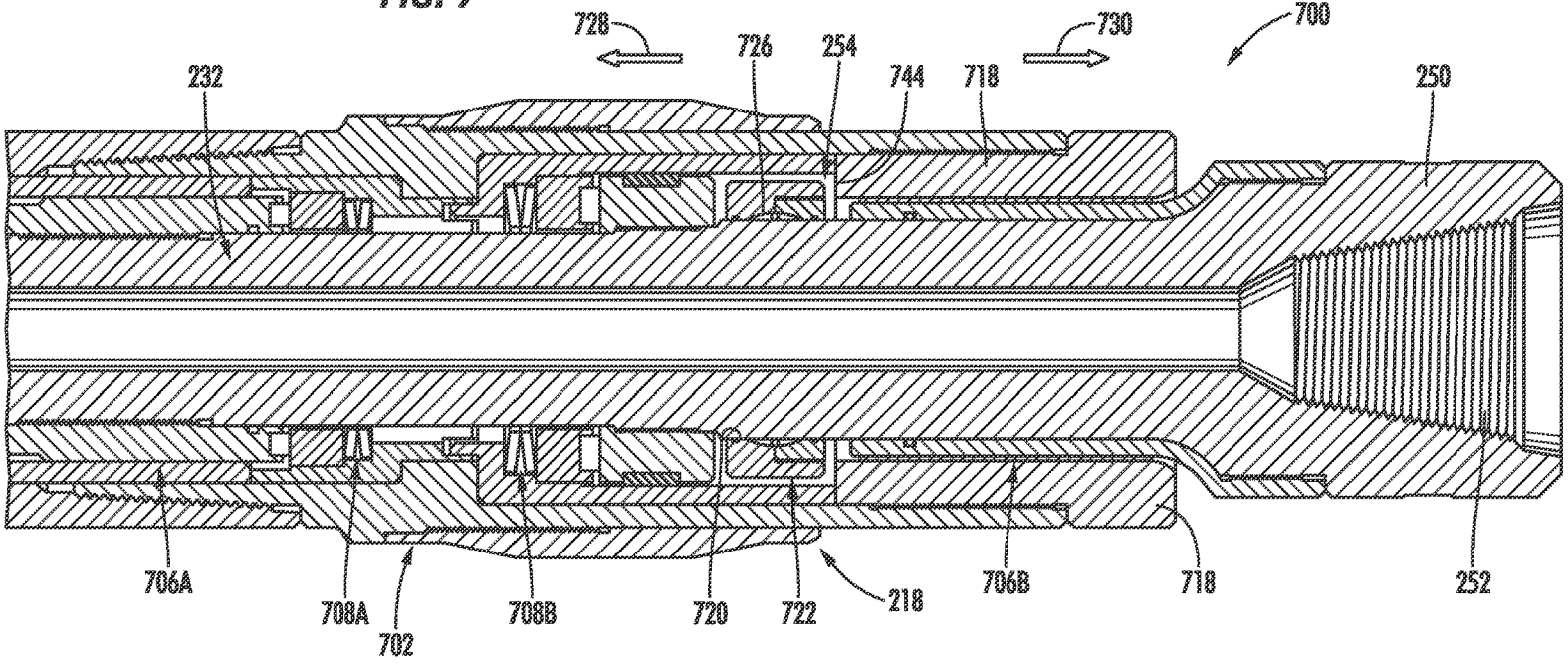
FIG. 7 is a vertical section depiction of the bearing assembly portion of the mud motor assembly of FIG. 2, depicting another embodiment of a catch assembly, in a second example placement.
Figure 8:
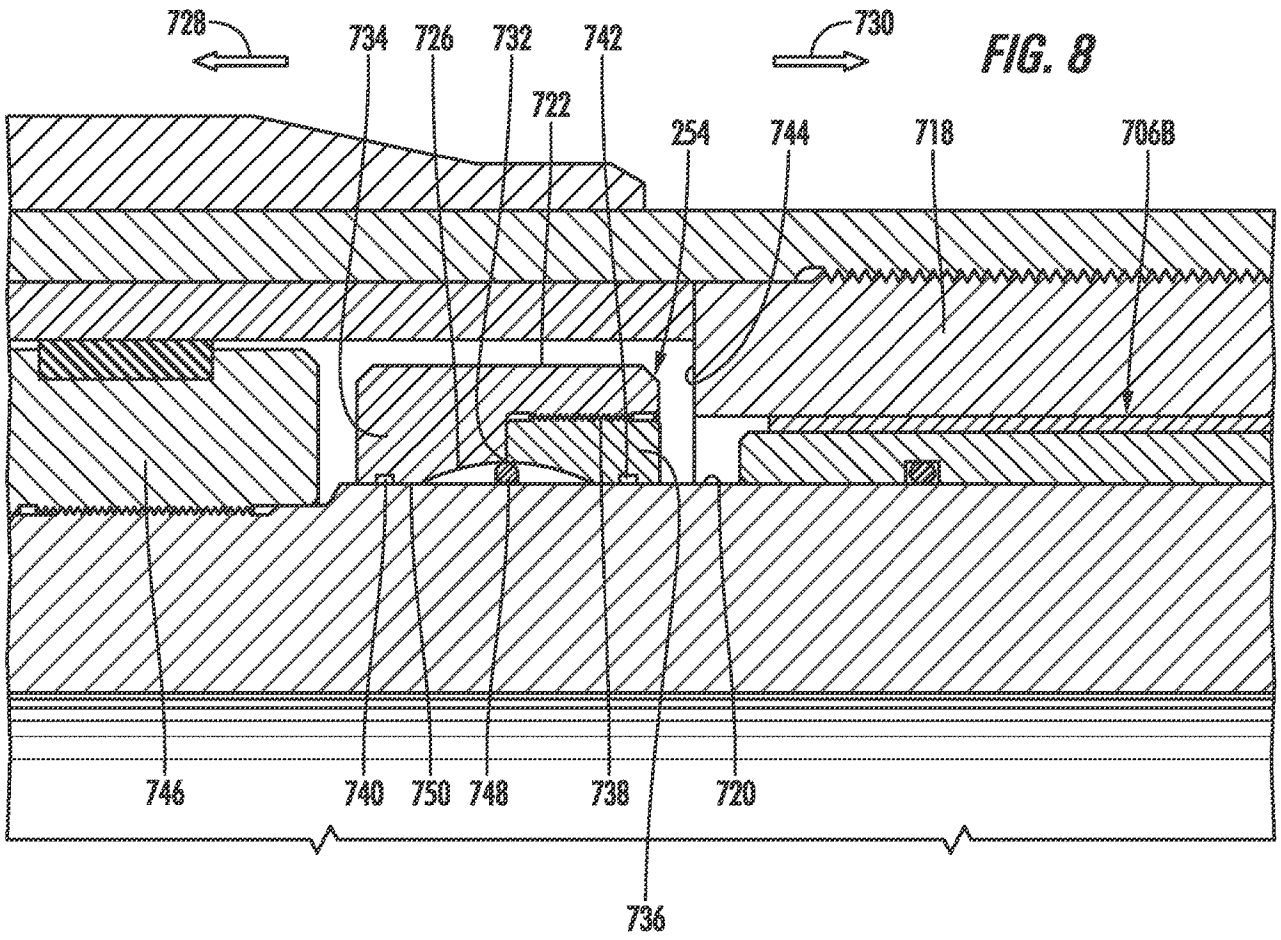
FIG. 8 is a vertical section of the portion of the bearing assembly of FIG. 7 housing the catch assembly, in an enlarged view.

Referring now to FIGS. 7 and 8, FIG. 7 is a vertical section of the bearing assembly 218 of FIG. 2, and showing second catch assembly 254; and FIG. 8 is a vertical section of the portion of bearing assembly 218 incorporating second catch assembly 254, depicted in greater detail. Bearing assembly 218 includes a housing assembly, indicated generally at 702. An output shaft 246 of the drivetrain 232 extends through bearing assembly 218, and includes a box coupling 250 to facilitate attachment to a drill bit or other rotating component to be coupled thereto (not depicted).

Bearing assembly 218 includes a pair of spaced radial bearing assemblies, indicated generally at 706A and 706B, configured to restrain rotation of output shaft 246 to rotation about a single axis. In the depicted example, a lower bearing cap 718 engages housing assembly 702, and forms a portion of the lower radial bearing assembly 706B In this configuration, lower radial bearing assembly 706B is used to support loading from the bit, while the upper radial bearing assembly 706A bears the internal loading of the drivetrain as the orbital rotation of the rotor is transferred to single axis rotation at the upper radial bearing assembly 706A. In other configurations, the housing and lower radial bearing assembly may be configured to allow placement of a catch beneath the bearing assembly.

Bearing assembly 218 also includes one or more longitudinal bearing assemblies (or "thrust bearings"), as indicated generally at 708A, 708B, configured to address compressional loads through the drivetrain, as may be encountered, for example, by the rotation and impacts of an attached drill bit while drilling. The specific configuration of individual bearing mechanisms, both radial and longitudinal, may be of any suitable configuration as known to persons skilled in the art.

Figure 9:
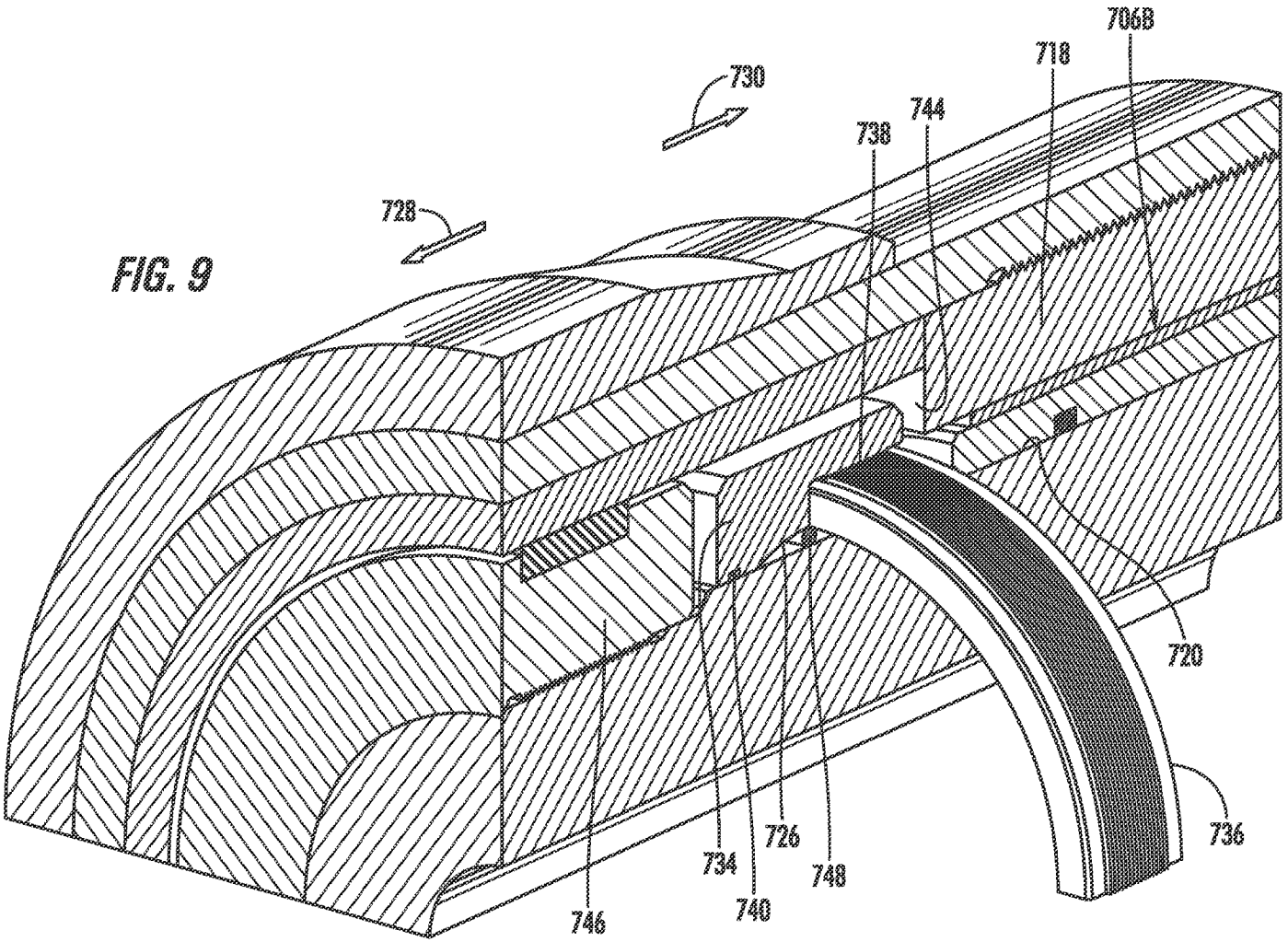
FIG. 9 depicts the vertical section of FIG. 8 in an oblique view, and with one portion of the catch assembly of FIGS. 7-8 in an extended representation relative to the vertical section.
Figure 10:
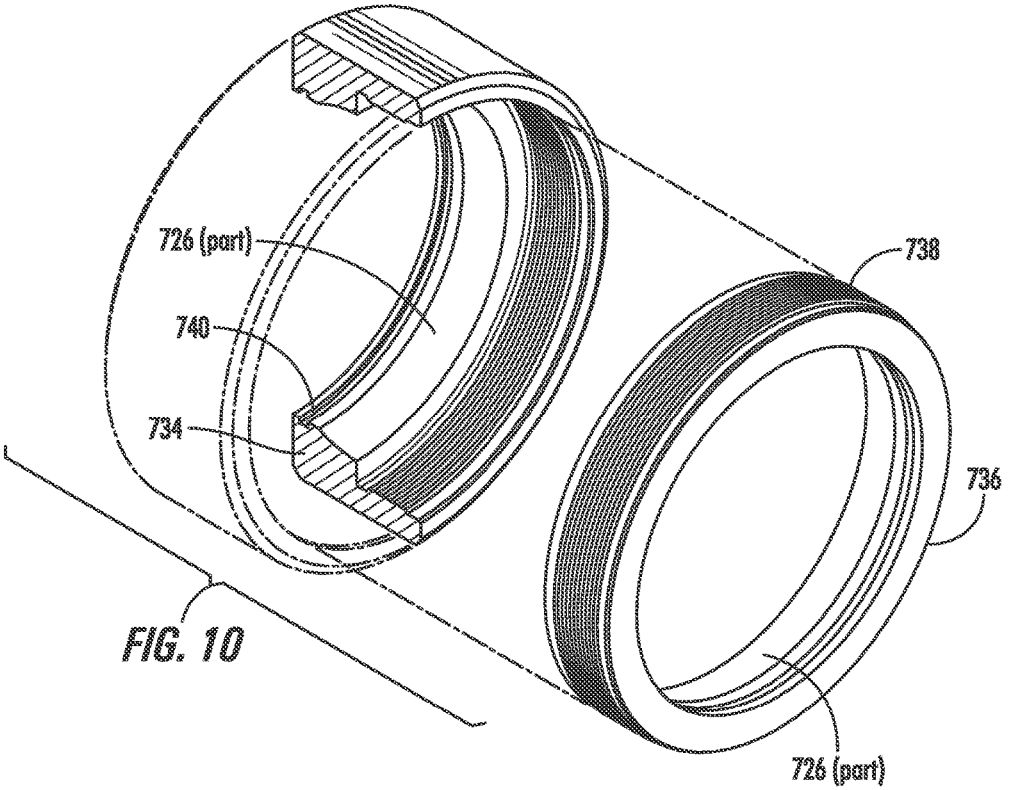
FIG. 10 is an exploded view depicting components of the body assembly portion of the catch assembly of FIGS. 7-9.
Figure 11:
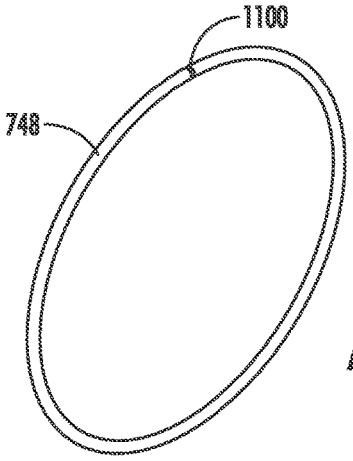
FIG. 11 is an oblique view of the engagement member of the catch assembly of FIGS. 7-9.

As identified previously herein, the drivetrain assembly must make a transition from orbital rotation at the rotor of the mud motor power section (204 in FIG. 2) to essentially single axis rotation within the radial bearing assemblies 706A, 706B. Because of the stresses imposed by this transition and those imposed by thrust loading on the drivetrain, one potential location of failure within a rotating drivetrain is closely adjacent the lowermost longitudinal (thrust) bearing assembly proximate the output shaft portion of the drivetrain. As a result, it is beneficial to place a catch element adjacent a relatively lower portion of the rotating drivetrain, and ideally below the lower thrust bearing assembly (708B), to enable retention of the lowermost portion of the drivetrain in the event of failure proximate the lower thrust bearing assembly 708B. As a result, it is beneficial to place a catch element adjacent a relatively lower portion of the rotating drivetrain. The compact size of the described catch assembly, and the ability of the assembly to dynamically engage a smooth cylindrical surface, facilitates placement of the catch assembly in the depicted position above—and generally adjacent the lower radial bearing assembly 706B, but below the thrust bearing assemblies as indicated at 708A, 708B. Thus the described catch assembly facilitates providing a catch assembly at a desirable location on the drivetrain assembly Referring now primarily to FIGS. 8-11, newly introduced FIG. 9 depicts the vertical section of FIG. 8 in an oblique view, and with one portion of the body assembly of catch assembly 254 shown in an expanded representation. FIG. 10 depicts the components of the body assembly (722) in an exploded view; and FIG. 11 depicts a locking member suitable for use in catch assembly 254. The depicted embodiment of catch assembly 254 provides an alternative configuration that is useful in engaging a continuous cylindrical surface of a drivetrain component, such as a surface not having a supporting shoulder (such as that indicated at 436 in FIG. 4A).

Catch assembly 254 is depicted in an operating orientation along a cylindrical surface 720 that extends continuously above and below the example placement of catch assembly 254. Catch assembly 254 includes a body assembly indicated generally at 722, which defines an internal circumferential recess, indicated generally at 726, which tapers in decreasing depth in both the uphole direction indicated by arrow 728, and the downhole direction, indicated by arrow 730, relative to a relatively central region 732. In the depicted example, recess 726 as an arcuate profile that extends generally symmetrically above and below a cross-sectional plane (i.e., a plane extending perpendicular plane of the vertical of FIG. 8). In other embodiments, the surfaces defining the circumferential recess may define a shape that is other than symmetrical in the described manner; and alternatively may define a profile that is not an essentially continuous arc, as depicted. As just one example, the circumferential recess could include for example, a cylindrical central portion with tapered regions both above and below the central portion. In the depicted example, outer sleeve 734 and inner sleeve 736 each have internal surfaces defining respective portions of circumferential recess 726. But it should be clearly understood that other configurations are possible for the specific configurations of body assembly 722 to provide a structure providing the described functionality.

In the depicted embodiment of catch assembly 254, body assembly 722 includes both an outer sleeve 734 and an inner sleeve 736 which threadably engages outer sleeve 734 at a threaded coupling 738. In catch assembly 254, outer sleeve 734 and inner sleeve 736 define a central aperture, indicated generally at 750, sized to closely engage the complementary surface 720 of output shaft 246. Outer sleeve 734 and inner sleeve 736 will, in many embodiments, again include appropriate structures, such as grooves 740, 742 configured to house suitable sealing assemblies, such as such as o-rings (not depicted), as described earlier herein. Because outer sleeve 734 and inner sleeve 736 thread together to form the completed body assembly 722, the two components can be sized to provide a generally flat lower surface when the two components are assembled. As can best be seen in FIG. 8, catch assembly 254 is restricted from downward by upper shoulder 744 of bearing cap 718. Similarly, in this embodiment, upper motion of catch assembly 254 is restricted by bearing block 746 of longitudinal bearing assembly 708B.

Catch assembly 254 again includes a generally annular engagement member 748 housed within circumferential recess 726 and sized to provide a friction engagement with cylindrical surface 720. Generally annular engagement member 748 will again preferably include a discontinuity defining a gap (indicated at 1100 in FIG. 12), sized to allow compression of the engagement member through engagement with either tapering surface of recess 726.

In operation, catch assembly 254 will operate in a manner partially similar to that previously described relative to catch assembly's 400, 500 and 600, in the event of a failure of supporting mud motor rotor (220 in FIG. 2) or the drivetrain assembly 232 (also in FIG. 2) in mud motor assembly 200, which would otherwise allow downward movement of mud motor rotor 220 and attached upper section 214. In such an event, downward movement of catch assembly 254 is limited due to the frictional engagement between locking member 748 and cylindrical surface 720. Downward movement of output shaft 246 relative to catch assembly 254 will cause locking member 748 to be pulled increasingly into the relatively downhole tapered of recess 726 which will compress locking member 748 into ever tighter engagement with cylindrical surface 720. This engagement then further secures catch assembly 254 to output shaft 246 and thereby prevents the shaft and the components coupled above it from falling away from housing assembly 702. Catch assembly 254 differs from the other embodiments, in that it also will restrict relative movement in the uphole direction. Such upward movement of output shaft 246 relative to catch assembly 254 will result in locking member 748 being compressed by the relatively uphole tapered portion of recess 726, into ever tighter engagement with cylindrical surface 720.

According to aspects of the present disclosure, a catch mechanism for a downhole motor may include an inner sleeve having an inner surface defining a central passage sized to extend around a generally cylindrical surface of a component of the downhole motor, with the inner sleeve defining at least a portion of a locking member recess relative to the inner surface. The catch mechanism will include at least one locking member moveably received in the locking member recess in the inner sleeve, and in many embodiments, the locking member recess will include a tapered portion in which the depth of the recess decreases in the direction of the downhole end of the inner sleeve. As discussed below, there may be multiple recesses, and there may be multiple locking members, with one or more locking members in each recess, and the locking member(s) may be of various alternative configurations. Any of these alternative configurations of catch mechanisms may include an outer sleeve to close the locking member recess, in some cases by extending either over or within a portion of the inner sleeve; and in some embodiments the outer sleeve will threadably couple to the inner sleeve.

According to some aspects of the disclosure, the locking member recess(s) will extend continuously around the inner circumference of the inner sleeve. In some such embodiments, the locking member can be a generally annular member, with in some embodiments, a discontinuity, such as a small gap, in the annular member. In some embodiments, the generally annular member will have a generally circular cross section, though other cross-sections or other configurations may also be used.

According to aspects of the disclosure in which the inner sleeve defines at least a portion of a group of locking member recesses spaced around the central passage of the inner sleeve, one or more locking members may be housed in each recess. In some such embodiments, each locking member recess may include a rotatable locking member, which in some cases will be in the form of a generally spherical locking member. In some embodiments, the at least one locking member may include a group of balls moveably received in the locking member recess.

According to aspects of the disclosure, a downhole motor will include a housing assembly, with a rotating component supported within the housing assembly, and a catch assembly coupled to some portion of the rotating component; and the catch assembly may be of any of the configurations referenced above.

In some embodiments, the rotating component may include a generally cylindrical engagement surface, and the catch assembly may include a body assembly having an inner surface defining a central passage sized to extend around the engagement surface of the rotating component; with the body assembly defining a locking member recess relative to the inner surface. As discussed, at least one engagement member will be retained in the locking member recess in the body member. In some embodiments, the locking member recess may include a first tapered portion in which the depth of the recess decreases in the direction of the downhole end of the body assembly.

In some embodiments, the body assembly may include a catch member and an inner sleeve. In some embodiments, the tapered portion of the locking member recess is defined at least in part by the inner sleeve. In some embodiments, the inner sleeve is threadably coupled to the catch member. In some embodiments, the locking member recess extends generally circumferentially around the inner surface of the body assembly; and will, in some examples, have a generally annular form.

In some embodiments, the body assembly defines a group of locking member recesses, each locking member recess having a first tapered portion in which the depth of the recess decreases in the direction of the downhole end of the body assembly. In some such embodiments, such catch assembly in the downhole motor may include a group of rollers, which, in some examples, may each be a metal ball.

In some embodiments, the engagement surface of the rotating component is a portion of the motor drivetrain extending within the motor bearing assembly. In some embodiments, the engagement surface is located above the lowermost radial bearing assembly, but below at least a portion of the longitudinal bearing assembly. In other embodiments, the engagement surface will be on a component about the rotor.

According to aspects of the disclosure, a method of assembling a downhole motor may include placing a rotating component of the motor within a housing assembly; placing a catch mechanism adjacent the generally cylindrical engagement surface; a first sleeve having an inner surface defining a central passage sized to extend around the generally cylindrical surface of the rotating component, the first sleeve defining at least a portion of a recess relative to the inner surface; at least one locking member moveably received in the recess in the first sleeve; a second sleeve extending over a portion of the first sleeve to close the recess; and/or securing the catch mechanism to be dynamically engageable with the generally cylindrical surface by securing the second sleeve to the first sleeve to retain the at least one locking member in the recess. The use of one or more locking members, which may be of any or various possible configurations, may in accordance with any of those discussed for the catch mechanisms.

In some such embodiments, the housing assembly supports a generally inwardly extending shoulder; and the rotating component may include a generally cylindrical engagement surface which will be placed in the housing such that the engagement surface is located to the uphole side of the radially extending shoulder; such that in the event of a failure, the catch mechanism can engage the shoulder in response to downward movement of the rotating component and locking member relative to the first sleeve.

In various embodiments of such disclosed methods, the recess of the catch mechanism may include a tapered portion in which the depth of the recess decreases in the direction of the downhole end of the first sleeve, to enable urging the locking member into engagement with the engagement surface.

Many variations may be made in the structures and techniques described and illustrated herein without departing from the scope of the inventive subject matter. Accordingly, the scope of the inventive subject matter is to be determined by the scope of the following claims and all additional claims supported by the present disclosure, and all equivalents of such claims.

We claim:

1. A catch mechanism for a downhole motor, comprising:

a first sleeve having an inner surface defining a central passage sized to extend around the cylindrical surface of a component of the downhole motor, the first sleeve defining at least a portion of a locking member recess relative to the inner surface, the locking member recess having a tapered portion in which the depth of the recess decreases in the direction of the downhole end of the first sleeve;

at least one locking member moveably received in the locking member recess in the first sleeve, and a second sleeve extending over a portion of the first sleeve to close the locking member recess.

2. The catch mechanism of claim 1, wherein the first sleeve defines at least a portion of a plurality of locking member recesses spaced around the central passage of the first sleeve.

3. The catch mechanism of claim 2, wherein each locking member recess includes a rotatable locking member.

4. The catch mechanism of claim 2, wherein each locking member recess includes a generally spherical locking member.

5. The catch mechanism of claim 1, wherein the locking member recess extends around the inner circumference of the first sleeve.

6. The catch mechanism of claim 5, wherein the locking member is a generally annular member having a discontinuity therein.

7. The catch mechanism of claim 6, wherein the generally annular member has a generally circular cross section.

8. The catch mechanism of claim 1, wherein the second sleeve threadably engages the first sleeve to close the locking member recess.

9. The catch mechanism of claim 1, wherein the locking member recess extends continuously around the inner surface of the first sleeve; and wherein the at least one locking member includes a plurality of balls moveably received in the locking member recess.

10. A downhole motor, comprising:

a housing assembly;

a rotating component supported within the housing assembly, the rotating component having an engagement surface; and a catch assembly, comprising, a body assembly comprising:

an inner sleeve comprising an inner surface defining a central passage sized to extend around the engagement surface of the rotating component, the inner sleeve defining at least a portion of a locking member recess relative to the inner surface, the locking member recess having a first tapered portion in which the depth of the recess decreases in the direction of the downhole end of the body assembly, a catch member, and at least one engagement member in the locking member recess in the body assembly.

11. The downhole motor of claim 10, wherein the inner sleeve is threadably coupled to the catch member.

12. The downhole motor of claim 10, wherein the at least one engagement member comprises a plurality of metal balls.

13. The downhole motor of claim 12, wherein the at least a portion of the locking member recess extends circumferentially around the inner surface of the inner sleeve; and wherein the plurality of balls are positioned in the locking member recess.

14. The downhole motor of claim 10, wherein the at least a portion of the locking member recess extends generally circumferentially around the inner surface of the inner sleeve, and wherein the engagement member has generally annular shape.

15. The downhole motor of claim 14, wherein the engagement member has a generally circular cross-section.

16. The downhole motor of claim 15, wherein the engagement member includes a discontinuity.

17. The downhole motor of claim 10, wherein the inner sleeve defines at least a portion of a plurality of locking member recesses, each locking member recess having a first tapered portion in which the depth of the recess decreases in the direction of the downhole end of the body assembly.

18. The downhole motor of claim 17, wherein each of the plurality of locking member recesses has at least one locking ball therein.

19. The downhole motor of claim 10, wherein the locking member recess further includes a second tapered section in which the depth of the recess decreases in the direction of the direction of the uphole end of the body assembly.

20. The downhole motor of claim 19, wherein the inner sleeve is placed adjacent a shoulder formed in a driveshaft assembly.

21. The downhole motor of claim 10, wherein the engagement surface of the rotating component is a portion of a motor drivetrain extending within a motor bearing assembly; and wherein the engagement surface is located above a lowermost radial bearing assembly, but below at least a portion of a longitudinal bearing assembly.

22. A method of assembling a downhole motor, comprising:

placing a rotating component of the motor within a housing assembly, wherein the housing assembly supports a generally inwardly extending shoulder, and wherein the rotating component includes a generally cylindrical engagement surface located to the uphole side of the radially extending shoulder;

placing a catch mechanism adjacent the generally cylindrical engagement surface, the catch mechanism including, a first sleeve having an inner surface defining a central passage sized to extend around the generally cylindrical surface of the rotating component, the first sleeve defining at least a portion of a recess relative to the inner surface, the recess having a tapered portion in which the depth of the recess decreases in the direction of the downhole end of the first sleeve; the at least one locking member moveably received in the recess in the first sleeve, and a second sleeve engaging a portion of the first sleeve to close the recess; and securing the catch mechanism to be dynamically engageable with the generally cylindrical surface by securing the second sleeve to the first sleeve to retain the at least one locking member in the recess, wherein the catch mechanism engages the engagement surface with increased force in response to downward movement of the rotating component and locking member relative to the first sleeve.

23. The method of claim 22, wherein the recess extends circumferentially around the inner surface of the first sleeve.

24. The method of claim 23, wherein the at least one locking member includes a generally annular ring extending around at least a portion of the generally cylindrical surface of the rotating component.

25. The method of claim 23, wherein the at least one locking member is a generally annular ring having a discontinuity therein.

* * * * *